US011104973B2

(12) United States Patent
Zaizen et al.

(10) Patent No.: US 11,104,973 B2
(45) Date of Patent: Aug. 31, 2021

(54) METHOD FOR PRODUCING NON-ORIENTED ELECTRICAL STEEL SHEET, METHOD FOR PRODUCING MOTOR CORE, AND MOTOR CORE

(71) Applicant: JFE Steel Corporation, Tokyo (JP)

(72) Inventors: Yoshiaki Zaizen, Tokyo (JP); Yoshihiko Oda, Tokyo (JP); Tomoyuki Okubo, Tokyo (JP)

(73) Assignee: JFE STEEEL CORPORATION, Tokyo (JP)

( * ) Notice: Subject to any disclaimer, the term of this patent is extended or adjusted under 35 U.S.C. 154(b) by 138 days.

(21) Appl. No.: 16/483,965

(22) PCT Filed: Jan. 19, 2018

(86) PCT No.: PCT/JP2018/001533
§ 371 (c)(1),
(2) Date: Aug. 6, 2019

(87) PCT Pub. No.: WO2018/147044
PCT Pub. Date: Aug. 16, 2018

(65) Prior Publication Data

US 2020/0010918 A1 Jan. 9, 2020

(30) Foreign Application Priority Data

Feb. 7, 2017 (JP) ..... JP2017-019994

(51) Int. Cl.
*C21D 8/12* (2006.01)
*C22C 38/02* (2006.01)
(Continued)

(52) U.S. Cl.
CPC ..... *C21D 8/1222* (2013.01); *C21D 1/30* (2013.01); *C21D 8/1233* (2013.01);
(Continued)

(58) Field of Classification Search
CPC ..... C21D 1/30; C21D 8/12; C21D 8/1222; C21D 8/1233; C22C 2202/02;
(Continued)

(56) References Cited

U.S. PATENT DOCUMENTS

2011/0273054 A1 11/2011 Johnston
2017/0229222 A1 8/2017 Nakanishi et al.
(Continued)

FOREIGN PATENT DOCUMENTS

CN 1380908 A 11/2002
CN 103667879 A 3/2014
(Continued)

OTHER PUBLICATIONS

Korean Office Action for Korean Application No. 10-2019-7023155, dated Dec. 29, 2020, with Concise Statement of Relevance of Office Action, 8 pages.
(Continued)

*Primary Examiner* — Jenny R Wu
(74) *Attorney, Agent, or Firm* — RatnerPrestia

(57) ABSTRACT

A method of producing a non-oriented electrical steel sheet by hot rolling and cold rolling a steel slab comprising by mass % C: not more than 0.0050%, Si: 2-7%, Mn: 0.05-2.0%, P: not more than 0.2%, S: not more than 0.005%, Al: not more than 3%, N: not more than 0.005%, Ti: not more than 0.003%, Nb: not more than 0.005% and V: not more than 0.005% and then subjecting to a finish annealing and a stress-relief annealing, conditions of the finish annealing and stress-relief annealing are adjusted so that a yield stress of the steel sheet after the finish annealing is not less than 400 MPa and a ratio of a magnetic flux density $B_{50S}$ of the steel sheet after the stress-relief annealing to a magnetic flux density $B_{50H}$ after the finish annealing is not less than 0.99.

4 Claims, 1 Drawing Sheet

(51) Int. Cl.

| | |
|---|---|
| ***C22C 38/04*** | (2006.01) |
| ***C22C 38/00*** | (2006.01) |
| ***C22C 38/06*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C21D 1/30*** | (2006.01) |
| ***H01F 1/147*** | (2006.01) |

(52) U.S. Cl.

CPC ..... *C22C 38/001* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *C22C 38/18* (2013.01); *H01F 1/147* (2013.01); *C22C 2202/02* (2013.01)

(58) Field of Classification Search

CPC ..... C22C 38/00; C22C 38/001; C22C 38/02; C22C 38/04; C22C 38/06; C22C 38/12; C22C 38/14; C22C 38/16; C22C 38/18; H01F 1/147

See application file for complete search history.

(56) References Cited

U.S. PATENT DOCUMENTS

| | | | |
|---|---|---|---|
| 2017/0260600 | A1 | 9/2017 | Okubo et al. |
| 2018/0066333 | A1 | 3/2018 | Nakajima et al. |

FOREIGN PATENT DOCUMENTS

| | | | | |
|---|---|---|---|---|
| EP | 1411138 | A1 | | 4/2004 |
| EP | 3037565 | A1 | | 6/2016 |
| JP | 03229821 | A | * | 10/1991 |
| JP | 2006131963 | A | | 5/2006 |
| JP | 2006213975 | A | | 8/2006 |
| JP | 2008050686 | A | | 3/2008 |
| JP | 2016138316 | A | | 8/2016 |
| JP | 2016151050 | A | | 8/2016 |
| WO | 2016017263 | A1 | | 2/2016 |
| WO | 2016024511 | A1 | | 2/2016 |
| WO | 2016132753 | A1 | | 8/2016 |

OTHER PUBLICATIONS

International Search Report and Written Opinion for International Application No. PCT/JP2018/001533, dated Apr. 3, 2018—6 pages.

Japanese Concise Statement of Relevance of Office Action for Japanese Application No. 2018-518664, dated May 29, 2098—5 pages.

Chinese Office Action for Chinese Application No. 201880010448.8, dated Aug. 27, 2020 with search report, 19 pages.

Extended European Search Report for European Application No. 18 750 858.5, dated Mar. 12, 2020, 7 pages.

Canadian Office Action for Canadian Application No. 3,051,823, dated Mar. 30, 2021, 4 pages.

English Translation of the Written Opinion for International Application No. PCT/JP2018/001533, dated Apr. 3, 2018, 6 pages.

* cited by examiner

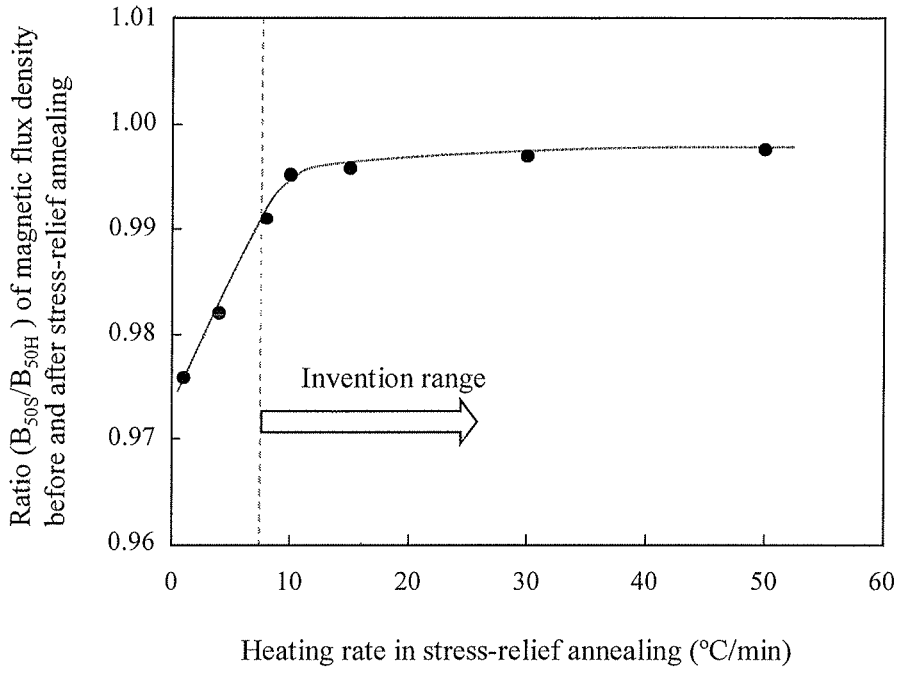
Ratio ($B_{50S}/B_{50H}$) of magnetic flux density before and after stress-relief annealing
1.01
1.00
0.99
0.98
0.97
0.96
0
10
20
30
40
50
60
Invention range
Heating rate in stress-relief annealing (°C/min)

METHOD FOR PRODUCING NON-ORIENTED ELECTRICAL STEEL SHEET, METHOD FOR PRODUCING MOTOR CORE, AND MOTOR CORE

CROSS REFERENCE TO RELATED APPLICATIONS

This is the U.S. National Phase application of PCT/JP2018/001533, filed Jan. 19, 2018, which claims priority to Japanese Patent Application No. 2017-019994, filed Feb. 7, 2017, the disclosures of each of these applications being incorporated herein by reference in their entireties for all purposes.

FIELD OF THE INVENTION

The present invention relates to a method for producing a non-oriented electrical steel sheet, a method for producing a motor core as well as a motor core, and more particularly to a method for producing a non-oriented electrical steel sheet which is small in reduction of magnetic flux density after stress-relief annealing as compared to magnetic flu density after finish annealing, and a method for producing a motor core as well as a motor core by using the non-oriented electrical steel sheet.

BACKGROUND OF THE INVENTION

In recent years, there is growing demand for higher efficiency of a rotary machine (motor) as an electric equipment with the increasing demand for energy saving. As a result, a non-oriented electrical steel sheet used in an iron core (core) of the rotary machine is demanded to have more excellent magnetic properties. Moreover, HEV driving motors and so on are recently strongly demanded to be small in size and high in output. In order to meet this demand, there is a tendency of increasing the rotation number of the motor.

A motor core comprises a fixed stator core and a rotating rotor core. In the rotor core such as HEV driving motor having a large outer diameter, a very large centrifugal force acts by a high-speed revolution. However, the rotor core includes a very narrow portion (1-2 mm) called as a rotor core bridge portion depending on the structure thereof. Thus, a non-oriented electrical steel sheet used in the rotor core is demanded to be high in strength as compared to conventional materials. On the other hand, in order to achieve downsizing and higher output of the motor, the material used for the stator core is demanded to have a high magnetic flux density and a low iron loss.

Therefore, it is ideal that the non-oriented electrical steel sheet used for an iron core of a motor is high in strength for the rotor core, and also high in the magnetic flux density and low in iron loss for the stator core. Thus, the electrical steel sheet is required to have different properties depending on for which of the rotor core or the stator core the steel sheet is used. However, in order to increase the manufacturability and material yield in the motor core, it is desirable that a rotor core material and a stator core material are simultaneously taken out from the same raw material by punching or the like and laminated to assemble the rotor core or the stator core.

The motor core, particularly stator core is subjected to stress-relief annealing for improvement of the magnetic properties by users (motor core manufacturers). According to the inventors' knowledge, however, comparative studies on magnetic flux density $B_{50}$ after finish annealing and magnetic flux density $B_{50}$ after stress-relief annealing have revealed a tendency that the magnetic flux density after the stress-relief annealing decreases. Further, there is a problem that such a steel sheet is not favorable as a steel sheet for stator, which particularly requires a high torque.

As the non-oriented electrical steel sheet having a high strength and excellent magnetic properties, for example, Patent Literature 1 proposes a non-oriented electrical steel sheet having a sheet thickness of not less than 0.15 mm but not more than 0.35 mm, a yield strength before stress-relief annealing of not less than 600 MPa and an iron loss $W_{10/400}$ after stress-relief annealing of not more than 20 W/kg, which is used in a method of constructing a motor core by laminating a rotor and a stator punched out from the same steel sheet and subjecting only the stator to stress-relief annealing.

PATENT LITERATURE

Patent Literature 1: JP-A-2008-50686

SUMMARY OF THE INVENTION

In the technique of Patent Literature 1, impurity elements included in steel such as Ti, S, N, V, Nb, Zr, As and so on are decreased to a very low level and further Ni is added in an amount of 0.5-3 mass % in order to promote crystal grain growth in the stress-relief annealing. However, Ni is a very expensive material, and Patent Literature 1 has conducted no examination on the magnetic flux density after the stress-relief annealing.

The present invention is made in view of the above conventional technique, and an object thereof is to propose a method for producing a non-oriented electrical steel sheet, which is high in strength after the finish annealing, excellent in magnetic properties after the stress-relief annealing, and particularly small in decrease of the magnetic flux density, without adding expensive Ni, and a method for producing a motor core as well as a motor core by using such a steel sheet.

The inventors have focused the influence of a chemical composition and production conditions upon a magnetic flux density $B_{50}$ after stress-relief annealing in order to solve the above task and made various studies. As a result, it has been found out that the strength of the steel sheet after the finish annealing can be increased by decreasing the impurity elements in steel as low as possible and increasing Si content, and such magnetic properties that the decrease of the magnetic flux density is small and the iron loss is low can be provided by subjecting the steel sheet after the finish annealing to a stress-relief annealing at a heating rate higher than that of the conventional techniques and hence a rotor core material having a high strength and a stator core material having a low iron loss and a high magnetic flux density can be simultaneously taken out from the same steel sheet after the finish annealing, and the invention has been accomplished.

The present invention according to exemplary embodiments is made based on the above knowledge and proposes a method for producing a non-oriented electrical steel sheet by hot rolling and cold rolling a steel slab having a chemical composition comprising C: not more than 0.0050 mass %, Si: 2-7 mass %, Mn: 0.05-2.0 mass %, P: not more than 0.2 mass %, S: not more than 0.005 mass %, Al: not more than 3 mass %, N: not more than 0.005 mass %, Ti: not more than 0.003 mass %, Nb: not more than 0.005 mass %, V: not more than 0.005 mass % and the remainder being Fe and inevitable impurities and then subjecting the obtained sheet to a finish annealing and a stress-relief annealing, characterized in that conditions of the finish annealing and stress-relief annealing are adjusted so that a yield stress of the steel sheet after the finish annealing is not less than 400 MPa and a ratio ($B_{50S}/B_{50H}$) of a magnetic flux density $B_{50S}$ of the steel sheet subjected to the stress-relief annealing after the finish annealing to a magnetic flux density $B_{50H}$ of the steel sheet after the finish annealing is not less than 0.99.

The steel slab used in the method for producing the non-oriented electrical steel sheet according to embodiments of the present invention is characterized by containing at least one of the following groups A-C:

Group A: one or two selected from Sn: 0.005-0.20 mass % and Sb: 0.005-0.20 mass %;

Group B: one or more selected from Ca: 0.001-0.010 mass %, Mg: 0.001-0.010 mass % and REM: 0.001-0.010 mass %;

Group C: one or two selected from Cr: 0.01-0.5 mass % and Cu: 0.01-0.2 mass %; in addition to the above chemical composition.

The method for producing the non-oriented electrical steel sheet according to embodiments of the present invention is characterized by adjusting the condition of the stress-relief annealing so as to satisfy the following equation (1):

$$W_{10/400} \leq 10+25t \quad (1),$$

wherein $W_{10/400}$ (W/kg) is an iron loss after the stress-relief annealing and t (mm) is a sheet thickness.

The method for producing the non-oriented electrical steel sheet according to embodiments of the present invention is characterized in that a soaking temperature is 750-950° C. and a soaking time is 0.1-10 hour and a heating rate from 600° C. to the soaking temperature is not less than 8° C./min, as the condition of the stress-relief annealing.

The present invention according to exemplary embodiments proposes a method for producing a motor core by taking out a rotor core material and a stator core material from the same raw material, characterized in that the rotor core is made from a non-oriented electrical steel sheet having a chemical composition comprising C: not more than 0.0050 mass %, Si: 2-7 mass %, Mn: 0.05-2.0 mass %, P: not more than 0.2 mass %, S: not more than 0.005 mass %, Al: not more than 3 mass %, N: not more than 0.005 mass %, Ti: not more than 0.003 mass %, Nb: not more than 0.005 mass %, V: not more than 0.005 mass % and the remainder being Fe and inevitable impurities and a yield stress of not less than 400 MPa, and the stator core is made by subjecting the non-oriented electrical steel sheet to a stress-relief annealing, and a ratio ($B_{50S}/B_{50H}$) of a magnetic flux density $B_{50S}$ of the stator core to a magnetic flux density $B_{50H}$ of the rotor core is not less than 0.99.

The non-oriented electrical steel sheet used in the method for producing the motor core according to embodiments of the present invention is characterized by containing at least one of the following groups A-C:

Group A: one or two selected from Sn: 0.005-0.20 mass % and Sb: 0.005-0.20 mass %;

Group B: one or more selected from Ca: 0.001-0.010 mass %, Mg: 0.001-0.010 mass % and REM: 0.001-0.010 mass %;

Group C: one or two selected from Cr: 0.01-0.5 mass % and Cu: 0.01-0.2 mass %, in addition to the above chemical composition.

The method for producing the motor core according to embodiments of the present invention is characterized by adjusting the condition of the stress-relief annealing so as to satisfy the following equation (1):

$$W_{10/400} \leq 10+25t \quad (1),$$

wherein $W_{10/400}$ (W/kg) is an iron loss after the stress-relief annealing and t (mm) is a sheet thickness.

The method for producing the motor core according to embodiments of the present invention is characterized in that the soaking temperature is 750-950° C. and the soaking time is 0.1-10 hour and the heating rate from 600° C. to the soaking temperature is not less than 8° C./min as the condition of the stress-relief annealing.

The present invention according to exemplary embodiments is a motor core comprising a rotor core material and a stator core material made from the same non-oriented electrical steel sheet, characterized in that the non-oriented electrical steel sheet has a chemical composition comprising C: not more than 0.0050 mass %, Si: 2-7 mass %, Mn: 0.05-2.0 mass %, P: not more than 0.2 mass %, S: not more than 0.005 mass %, Al: not more than 3 mass %, N: not more than 0.005 mass %, Ti: not more than 0.003 mass %, Nb: not more than 0.005 mass %, V: not more than 0.005 mass % and the remainder being Fe and inevitable impurities, and a yield stress of the rotor core material is not less than 400 MPa, and a ratio ($B_{50S}/B_{50H}$) of a magnetic flux density $B_{50S}$ of the stator core to a magnetic flux density $B_{50H}$ of the rotor core is not less than 0.99.

The non-oriented electrical steel sheet used in the motor core according to embodiments of the present invention is characterized by containing at least one of the following groups A-C:

Group A: one or two selected from Sn: 0.005-0.20 mass % and Sb: 0.005-0.20 mass %;

Group B: one or more selected from Ca: 0.001-0.010 mass %, Mg: 0.001-0.010 mass % and REM: 0.001-0.010 mass %;

Group C: one or two selected from Cr: 0.01-0.5 mass % and Cu: 0.01-0.2 mass %, in addition to the above chemical composition.

Also, the stator core material used in the motor core according to embodiments of the present invention is characterized by satisfying the following equation (1):

$$W_{10/400} \leq 10+25t \quad (1),$$

wherein $W_{10/400}$ (W/kg) is an iron loss after the stress-relief annealing and t (mm) is a sheet thickness.

According to embodiments of the present invention, there is provided a non-oriented electrical steel sheet having a high strength after finish annealing and being small in decrease of magnetic flux density after stress-relief annealing. According to embodiments of the present invention, therefore, the rotor core material and the stator core material can be simultaneously taken out from the same material steel sheet, which largely contributes to increase of the efficiency of the motor core and improvement of the productivity thereof.

BRIEF DESCRIPTION OF DRAWING

The FIGURE is a graph showing an influence of a heating rate in stress-relief annealing upon a ratio ($B_{50S}/B_{50H}$) of a magnetic flux density after stress-relief annealing $B_{50S}$ to a magnetic flux density after finish annealing $B_{50H}$.

DETAILED DESCRIPTION OF EMBODIMENTS OF THE INVENTION

An experiment building a momentum of developing embodiments of the present invention will be described below.

In order to examine an influence of a heating rate in stress-relief annealing upon a magnetic flux density after stress-relief annealing $B_{50}$, a steel containing C: 0.0022 mass %, Si: 3.1 mass %, Mn: 0.54 mass %, P: 0.01 mass %, S: 0.0016 mass %, Al: 0.6 mass %, N: 0.0018 mass %, O: 0.0023 mass %, Ti: 0.0014 mass %, Nb: 0.0006 mass % and V: 0.0015 mass % is melted in a vacuum furnace to form a steel ingot, which is hot rolled to obtain a hot rolled sheet having a sheet thickness of 2.0 mm. The hot rolled sheet is subjected to a hot band annealing at 950° C. for 30 seconds, pickled and cold rolled to obtain a cold rolled sheet having a sheet thickness of 0.25 mm. The cold rolled sheet is then subjected to a finish annealing by holding in a non-oxidizing atmosphere of 20 vol % H2-80 vol % $N_2$ at a temperature of 850° C. for 10 seconds to obtain a non-oriented electrical steel sheet.

The magnetic flux density $B_{50}$ of the steel sheet after the finish annealing is measured by a 25 cm Epstein method. In the present invention, the magnetic flux density after the finish annealing is also represented as "$B_{50H}$".

Further, a JIS No. 5 tensile test specimen is taken out from the finish annealed sheet in the rolling direction as a tensile direction and subjected to a tensile test to obtain a yield stress of 480 MPa.

The above Epstein test specimen is then subjected to a stress-relief annealing in $N_2$ atmosphere at 825° C. for 2 hours and a magnetic flux density $B_{50}$ thereof is again measured by the 25 cm Epstein method. In this measurement, the heating rate from 600 to 825° C. is variously changed within the range of 1-50° C./min. In the present invention, the magnetic flux density after the stress-relief annealing is also represented as "$B_{50S}$".

The FIGURE shows a relation between a heating rate from 600° C. to 825° C. in the stress-relief annealing and a ratio ($B_{50S}/B_{50H}$) of a magnetic flux density after the stress-relief annealing to a magnetic flux density after the finish annealing. As seen from this FIGURE, the decrease of the magnetic flux density in the stress-relief annealing is suppressed by increasing the heating rate in the stress-relief annealing to not less than 8° C./min. This is thought due to the fact that grain growth of {100} orientation and {110} orientation desirable for magnetic properties in the stress-relief annealing is promoted by the increase of the heating rate, and hence grain growth of {111} orientation causing the decrease of the magnetic flux density is suppressed.

The chemical composition of the non-oriented electrical steel sheet (product sheet) according to embodiments of the present invention is described below.

C: not more than 0.0050 mass %

C is a harmful element forming a carbide to cause magnetic aging and deteriorate the iron loss property of the product sheet, so that the upper limit thereof is limited to 0.0050 mass %. It is preferably not more than 0.0030 mass %. Moreover, C content is preferable to get lower, so that the lower limit thereof is not particularly limited.

Si: 2-7 mass %

Si is an element increasing an intrinsic resistance of steel to reduce an iron loss and solid-soluting steel to increase a strength, so that it is added in an amount of not less than 2 mass %. However, an addition of Si exceeding 7 mass % makes it difficult to conduct rolling, and therefore the upper limit of Si is 7 mass %. It is preferably in the range of 2.5-6.5 mass %, more preferably in the range of 3.0-6.0 mass %.

Mn: 0.05-2.0 mass %

Mn is an element increasing the intrinsic resistance and strength of steel like Si and being effective for preventing hot shortness resulted from S. In an embodiment of the present invention, therefore, it is added in an amount of not less than 0.05 mass %. However, when the addition amount exceeds 2.0 mass %, the operability in the steel-making is deteriorated, so that the upper limit is 2.0 mass %. It is preferably in the range of 0.1-1.5 mass %, more preferably in the range of 0.1-1.0 mass %.

P: not more than 0.2 mass %

P is an element used in the adjustment of steel strength (hardness) because of a high solid-solution strengthening behavior. However, an addition of P exceeding 0.2 mass % makes it difficult to conduct rolling due to embrittlement of steel, so that the upper limit is 0.2 mass %. Moreover, the lower limit is not particularly limited. It is preferably in the range of 0.001-0.15 mass %, more preferably in the range of 0.001-0.10 mass %.

Al: not more than 3 mass %

Al has an effect of increasing a specific resistance of steel to reduce an iron loss. However, an amount of Al exceeding 3 mass % makes it difficult to conduct rolling, so that the upper limit is 3 mass %. When the Al content is more than 0.01 mass % but less than 0.1 mass %, fine MN is precipitated to increase the iron loss, and hence Al is preferably not more than 0.01 mass % or falls within the range of 0.1-2.0 mass %. Especially, as Al is decreased, the texture can be improved to increase the magnetic flux density, so that when the above effect is important, Al is preferably not more than 0.01 mass %. More preferably, it is not more than 0.003 mass %.

S, N, Nb and V: not more than 0.005 mass % each

S, N, Nb and V are harmful elements forming fine precipitates of carbide, nitride, sulfide and so on to block the grain growth in the stress-relief annealing and increase the iron loss. In particular, an addition exceeding 0.005 mass % makes the above bad influence remarkable. Therefore, the upper limit of each element is 0.005 mass %. It is preferably not more than 0.003 mass %.

Ti: not more than 0.003 mass %

Ti is a harmful element forming and precipitating fine carbonitride and the like to block the grain growth in the stress-relief annealing and increase an iron loss. In particular, when it exceeds 0.003 mass %, the above bad influence becomes remarkable, so that the upper limit is 0.003 mass %. Preferably, it is not more than 0.002 mass %.

The non-oriented electrical steel sheet according to the present invention may contain the following ingredients in addition to the above basic ingredients.

Sn, Sb: 0.005-0.20 mass % each

Sn and Sb have an effect of improving the recrystallized texture to improve the magnetic flux density and iron loss property. In order to obtain the above effect, each element is necessary to be added in an amount of not less than 0.005 mass %. When they are added in an amount exceeding 0.20 mass % in total, the above effect is saturated. Therefore, when Sn and Sb are added, each amount is preferable to fall within the range of 0.005-0.20 mass %. It is more preferably within a range of 0.01-0.05 mass %.

Ca, Mg, REM: 0.001-0.010 mass % each

Ca, Mg and REM have an effect of forming stable sulfide and selenide to improve the grain growth property in the stress-relief annealing. In order to obtain the above effect, it is necessary to be added in an amount of not less than 0.001 mass %. While when it is added in an amount exceeding 0.010 mass %, inclusions are increased and the iron loss property is rather deteriorated. Therefore, when Ca, Mg and REM are added, it is preferable to add each element within a range of 0.001-0.010 mass %. More preferably, each element falls within the range of 0.002-0.005 mass %.

Cr: 0.01-0.5 mass %

Cr has an effect of increasing the intrinsic resistance to reduce an iron loss. In order to obtain the above effect, it is necessary to be contained in an amount of not less than 0.01 mass %. On the other hand, when it exceeds 0.5 mass %, the raw material cost is unfavorably increased. When Cr is added, therefore, it is preferable to be added within the range of 0.01-0.5 mass %. More preferably, it is within the range of 0.1-0.4 mass %.

Cu: 0.01-0.2 mass %

Cu has an effect of improving the texture to increase magnetic flux density. In order to obtain the above effect, it is necessary to be added in an amount of not less than 0.01 mass %. On the other hand, when it exceeds 0.2 mass %, the above effect is saturated. Therefore, when Cu is added, the addition amount is preferably in the range of 0.01-0.2 mass %. More preferably, it is in the range of 0.05-0.15 mass %.

Moreover, the remainder other than the above ingredients is Fe and inevitable impurities.

The mechanical properties and magnetic properties of the non-oriented electrical steel sheet according to embodiments of the present invention will be described below.

Yield stress after finish annealing (before stress-relief annealing): not less than 400 MPa.

For a use as a rotor core material requiring the strength, the steel sheet after the finish annealing is necessary to have a yield stress of not less than 400 MPa. When the yield stress is less than 400 MPa, it is potentially impossible to withstand the centrifugal force based on high-speed revolution applied by HEV driving motor or the like. The yield stress is preferably not less than 450 MPa. Here, the yield stress means an upper yield point when the tensile test is conducted in the rolling direction of the steel sheet. Moreover, the test specimen used in the tensile test and the test conditions may only be in accordance with JIS.

$B_{50S}/B_{50H}$: not less than 0.99

The non-oriented electrical steel sheet according to embodiments of the present invention is characterized in that the decrease of the magnetic properties, particularly magnetic flux density by the stress-relief annealing is small. Concretely, the ratio ($B_{50S}/B_{50H}$) of magnetic flux density $B_{50S}$ after stress-relief annealing to magnetic flux density $B_{50H}$ before stress-relief annealing is necessary to be not less than 0.99. When the ratio ($B_{50S}/B_{50H}$) is less than 0.99, torque required as an application for stator is not attained. $B_{50S}/B_{50H}$ is preferably not less than 0.995.

Iron loss after stress-relief annealing $W_{10/400}$: not more than 10+25t (mm)

In the non-oriented electrical steel sheet according to embodiments of the present invention, the iron loss after the stress relief annealing $W_{10/400}$ (frequency: 400 Hz, magnetic flux density B=1.0 T) preferably satisfies the following equation (1):

$$W_{10/400}(W/kg) \leq 10+25t \text{ (mm)} \quad (1),$$

as a relation to a sheet thickness t (mm). More preferably, $W_{10/400}$ is not more than 10+20t.

When the iron loss after the stress-relief annealing $W_{10/400}$ is outside the above range, heat generation of the stator core becomes larger and the motor efficiency is decreased significantly.

Moreover, the reason why the iron loss $W_{10/400}$ is used in the present invention as an indication of the iron loss property is due to the fact that it is fitted to driving/controlling conditions of HEV driving motor.

In an embodiment of the present invention, the stress-relief annealing, which is performed on the steel sheet after the finish annealing, is conducted under conditions that a soaking temperature is 750-950° C. and a soaking time is 0.1-10 hour and a heating rate from 600° C. to the soaking temperature is not less than 8° C./min. In the production of the motor core, the stress-relief annealing is usually conducted after the assembling into the core form, so that the magnetic properties after the stress-relief annealing cannot be measured directly. In an embodiment of the present invention, therefore, the magnetic flux density $B_{50S}$ and iron loss $W_{10/400}$ after the stress-relief annealing are substituted by a magnetic flux density and an iron loss after heat treatment is conducted to the steel sheet after the finish annealing under conditions simulating the stress-relief annealing. It is more preferable that the soaking temperature falls within the range of 800-900° C. and the soaking time falls within the range of 0.5-2 hour and the heating rate is not less than 10° C./min.

The method for producing the non-oriented electrical steel sheet according to embodiments of the present invention will be described below.

The non-oriented electrical steel sheet according to the invention can be produced by melting a steel having the chemical composition adapted according to embodiments of the present invention through a conventionally well-known refining process using a convertor, an electric furnace, a vacuum degassing device or the like, forming a steel slab through a continuous casting process or an ingot making-blooming process, hot rolling the steel slab through a well-known method to form a hot rolled sheet, subjecting the hot rolled sheet to a hot band annealing if necessary, and subjecting the sheet to cold rolling and finish annealing.

When the hot band annealing is performed, a soaking temperature preferably falls within the range of 800-1100° C. When it is lower than 800° C., the effect of the hot band annealing is small and the effect of improving the magnetic properties cannot be obtained sufficiently, while when it exceeds 1100° C., it becomes disadvantageous in cost and the crystal grains are coarsened to promote brittle fracture in the cold rolling. More preferably, the soaking temperature in the hot band annealing falls within the range of 850-1000° C.

The cold rolling after the hot rolling or after the hot band annealing is preferably conducted once or twice or more interposing an intermediate annealing therebetween. The cold rolling for rolling the sheet to a final sheet thickness (final cold rolling) is preferably a warm rolling conducted at not lower than 200° C. from a viewpoint of increasing the magnetic flux density. Furthermore, the final sheet thickness in the cold rolling preferably falls within the range of 0.1-0.3 mm. When it is less than 0.1 mm, the productivity lowers, while when it exceeds 0.3 mm, the effect of decreasing the iron loss is small. More preferably, it falls within the range of 0.15-0.27 mm.

The finish annealing, which is conducted to the cold rolled sheet having the final sheet thickness, is preferably a continuous annealing by soaking the sheet in the range of 700-1000° C. for 1-300 seconds. When the soaking temperature is lower than 700° C., the recrystallization is not promoted sufficiently, and hence the good magnetic properties cannot be obtained and the effect of correcting the shape by the continuous annealing cannot be obtained. On the other hand, when it exceeds 1000° C., the crystal grain size is coarsened to decrease the strength of the steel sheet. Moreover, in order to apply the strength required as a rotor core to the steel sheet after the finish annealing, it is preferable in the finish annealing that the soaking temperature is low and soaking time is short as far as possible within the above ranges and in an allowable range for the iron loss property and shape. More preferably, the finish annealing conditions are that the soaking temperature is 750-900° C. and the soaking tine is 10-60 seconds.

In order to ensure the insulating property in the lamination and/or improve the punchability, it is preferable that an insulation coating is formed on the surface of the steel sheet after the finish annealing. The insulation coating is preferably an organic coating containing a resin in order to ensure a good punchability, while it is preferably a semi-organic or inorganic coating when a weldability is important.

Since the steel sheet after the finish annealing and the steel sheet further provided with the insulation coating are high in strength having a yield stress of not less than 400 MPa, they are suitable as a raw material for the rotor core, which is formed by working the sheet into a core form (rotor core material) through punching or the like and laminating them.

On the other hand, the stator core is required to have a low iron loss and a high magnetic flux density, so that the steel sheet is preferable to be worked into a core form (stator core material) through punching or the like and laminated to form a rotor core and then subjected to the stress-relief annealing.

In the production of the motor core, it is important in embodiments of the present invention that the stator core material and the rotor core material are simultaneously taken out from the same steel sheet to stably satisfy a condition that a ratio ($B_{50S}/B_{50H}$) of a magnetic flux density $B_{50S}$ after stress-relief annealing to a magnetic flux density $B_{50H}$ before stress-relief annealing is not less than 0.99. If the stator core material and the rotor core material are taken out from different materials, a probability that ($B_{50S}/B_{50H}$) is less than 0.99 becomes higher. Even when ($B_{50S}/B_{50H}$) of not less than 0.99 is satisfied by taking out from the different materials, unnecessary portion becomes larger after the formation of each of the stator core material and the rotor core material, and hence the material yield is largely deteriorated to increase the cost.

As previously mentioned, the stress-relief annealing is preferably conducted in an inert gas atmosphere under such an condition at 750-950° C. for 0.1-10 hour, and more preferably under a condition at 800-900° C. for 0.5-2 hour. When the annealing temperature is lower than 750° C. and/or the annealing time is less than 0.1 hour, the grain growth is insufficient and the effect of improving the iron loss after the stress-relief annealing cannot be obtained, while when the annealing temperature is higher than 950° C. and/or the annealing time exceeds 10 hour, the insulation coating is broken and it is difficult to ensure the insulating property between the steel sheets and the iron loss is increased.

Further, the heating rate from 600° C. to the stress-relief annealing temperature in the stress-relief annealing is preferably not less than 8° C./min as previously mentioned, more preferably not less than 10° C./min.

As mentioned above, the non-oriented electrical steel sheet according to embodiments of the present invention have properties that the yield stress after the finish annealing is high and the decrease of the magnetic flux density in the stress-relief annealing is small, so that the rotor core requiring the high strength and the stator core requiring the low iron loss and the high magnetic flux density can be produced from the one sheet material.

EXAMPLE 1

A steel having a chemical composition shown in Table 1 is melted to form a steel slab, which is heated at 1100° C. for 30 minutes and then hot rolled to form a hot rolled sheet having a sheet thickness of 1.8 mm. Thereafter, the hot rolled sheet is subjected to a hot band annealing at 980° C. for 30 seconds and cold rolled once to form a cold rolled sheet having a final sheet thickness shown in Table 2, which is then subjected to a finish annealing by holding at a temperature shown in Table 2 for 10 seconds to obtain a non-oriented electrical steel sheet.

Then, a sample of L: 280 mm×C: 30 mm in L-direction (rolling direction) and a sample of C: 280 mm×L: 30 mm in C-direction (direction perpendicular to the rolling direction) are cut out from the steel sheet after the finish annealing and subjected to an Epstein test to measure a magnetic flux density $B_{50H}$.

A JIS No. 13 test specimen is also taken out from the finish annealed sheet in L-direction and subjected to a tensile test.

Thereafter, the test specimen after the Epstein test is subjected to a heat treatment in a $N_2$ atmosphere simulating a stress-relief annealing of the heating rate, soaking temperature and soaking time shown in Table 2 and the Epstein test is again performed to measure a magnetic flux density $B_{50S}$ after stress-relief annealing and calculate a ratio $B_{50S}/B_{50H}$. At the same time, an iron loss $W_{10/400}$ after the stress-relief annealing is measured.

The measured results are also shown in Table 2. As seen from these results, the non-oriented electrical steel sheets produced by the method according to embodiments of the present invention have high strength after the finish annealing and excellent magnetic properties such as low iron loss and high magnetic flux density. The non-oriented electrical steel sheets also have a property suitable for use in a motor core of HEV driving motor and the like.

TABLE 1

| Steel | Chemical composition (mass %) | | | | | | | | | | | | | | |
|---|---|---|---|---|---|---|---|---|---|---|---|---|---|---|---|
| symbol | C | Si | Mn | P | S | Al | N | Ti | Nb | V | Sn | Sb | O | Others | Remarks |
| A | 0.0019 | 3.5 | 0.40 | 0.01 | 0.0014 | 0.90 | 0.0024 | 0.0013 | 0.0016 | 0.0011 | 0.001 | 0.001 | 0.0017 | — | Invention steel |
| B | 0.0018 | 3.8 | 0.30 | 0.01 | 0.0019 | 0.60 | 0.0024 | 0.0009 | 0.0014 | 0.0007 | 0.04 | 0.001 | 0.0014 | — | Invention steel |
| C | 0.0019 | 1.4 | 0.40 | 0.01 | 0.0014 | 0.80 | 0.0024 | 0.0013 | 0.0016 | 0.0011 | 0.001 | 0.001 | 0.0017 | — | Comparative steel |
| D | 0.0019 | 4.5 | 0.50 | 0.01 | 0.0017 | 0.30 | 0.0021 | 0.0011 | 0.0012 | 0.0009 | 0.001 | 0.001 | 0.0019 | — | Invention steel |
| E | 0.0019 | 7.6 | 0.50 | 0.01 | 0.0017 | 0.30 | 0.0021 | 0.0011 | 0.0012 | 0.0009 | 0.001 | 0.001 | 0.0019 | — | Comparative steel |
| F | 0.0024 | 3.4 | 1.20 | 0.01 | 0.0019 | 0.30 | 0.0029 | 0.0013 | 0.0016 | 0.0011 | 0.001 | 0.001 | 0.0024 | — | Invention steel |
| G | 0.0024 | 3.4 | 2.50 | 0.01 | 0.0019 | 0.50 | 0.0029 | 0.0013 | 0.0016 | 0.0011 | 0.001 | 0.001 | 0.0024 | — | Comparative steel |
| H | 0.0022 | 2.6 | 0.50 | 0.01 | 0.0019 | 0.001 | 0.0031 | 0.0012 | 0.0011 | 0.0008 | 0.001 | 0.001 | 0.0028 | — | Invention steel |
| I | 0.0022 | 2.6 | 0.50 | 0.01 | 0.0019 | 0.001 | 0.0031 | 0.0012 | 0.0011 | 0.0008 | 0.10 | 0.001 | 0.0028 | — | Invention steel |
| J | 0.0022 | 2.6 | 0.50 | 0.01 | 0.0019 | 0.001 | 0.0031 | 0.0012 | 0.0008 | 0.0008 | 0.001 | 0.001 | 0.0028 | — | Invention steel |
| K | 0.0022 | 2.6 | 0.50 | 0.08 | 0.0019 | 0.001 | 0.0031 | 0.0004 | 0.0011 | 0.0008 | 0.001 | 0.001 | 0.0028 | — | Invention steel |
| L | 0.0022 | 2.6 | 0.50 | 0.24 | 0.0019 | 0.001 | 0.0024 | 0.0012 | 0.0011 | 0.0008 | 0.001 | 0.001 | 0.0023 | — | Comparative steel |
| M | 0.0022 | 2.6 | 0.50 | 0.01 | 0.0019 | 0.001 | 0.0031 | 0.0012 | 0.0011 | 0.0008 | 0.001 | 0.001 | 0.0028 | Ca: 0.003 | Invention steel |

TABLE 1-continued

| Steel symbol | Chemical composition (mass %) C | Si | Mn | P | S | Al | N | Ti | Nb | V | Sn | Sb | O | Others | Remarks |
|---|---|---|---|---|---|---|---|---|---|---|---|---|---|---|---|
| N | 0.0022 | 3.0 | 0.50 | 0.01 | 0.0019 | 0.001 | 0.0021 | 0.0008 | 0.0006 | 0.0008 | 0.001 | 0.001 | 0.0018 | REM: 0.005 | Invention steel |
| O | 0.0019 | 3.1 | 0.40 | 0.01 | 0.0014 | 1.50 | 0.0024 | 0.0013 | 0.0016 | 0.0011 | 0.001 | 0.001 | 0.0017 | — | Invention steel |
| P | 0.0019 | 2.4 | 0.40 | 0.01 | 0.0014 | 2.20 | 0.0024 | 0.0013 | 0.0016 | 0.0011 | 0.001 | 0.001 | 0.0017 | — | Invention steel |
| Q | 0.0019 | 2.8 | 0.40 | 0.01 | 0.0014 | 3.60 | 0.0024 | 0.0013 | 0.0016 | 0.0011 | 0.001 | 0.001 | 0.0017 | — | Comparative steel |
| R | 0.0022 | 3.4 | 0.50 | 0.01 | 0.0019 | 0.001 | 0.0059 | 0.0012 | 0.0011 | 0.0008 | 0.001 | 0.001 | 0.0028 | — | Comparative steel |
| S | 0.0022 | 3.4 | 0.50 | 0.01 | 0.0019 | 0.001 | 0.0018 | 0.0012 | 0.0011 | 0.0008 | 0.001 | 0.001 | 0.0064 | — | Comparative steel |
| T | 0.0022 | 3.4 | 0.50 | 0.01 | 0.0019 | 0.001 | 0.0018 | 0.0045 | 0.0011 | 0.0008 | 0.001 | 0.001 | 0.0021 | — | Comparative steel |
| U | 0.0022 | 3.4 | 0.50 | 0.01 | 0.0019 | 0.001 | 0.0018 | 0.0012 | 0.0057 | 0.0008 | 0.001 | 0.001 | 0.0023 | — | Comparative steel |
| V | 0.0022 | 3.4 | 0.50 | 0.01 | 0.0019 | 0.001 | 0.0018 | 0.0012 | 0.0014 | 0.0062 | 0.001 | 0.001 | 0.0023 | — | Comparative steel |
| W | 0.0025 | 3.2 | 0.20 | 0.01 | 0.0015 | 0.800 | 0.0022 | 0.0011 | 0.0011 | 0.0009 | 0.04 | 0.001 | 0.0027 | Cr: 0.05 | Invention steel |
| X | 0.0024 | 3.1 | 0.30 | 0.01 | 0.0015 | 0.800 | 0.0022 | 0.0011 | 0.0011 | 0.0009 | 0.04 | 0.001 | 0.0027 | Cr: 0.20 | Invention steel |
| Y | 0.0025 | 3.0 | 0.20 | 0.01 | 0.0015 | 0.900 | 0.0022 | 0.0011 | 0.0011 | 0.0009 | 0.04 | 0.001 | 0.0027 | Cr: 0.40 | Invention steel |
| Z | 0.0026 | 3.2 | 0.30 | 0.01 | 0.0016 | 0.900 | 0.0024 | 0.0012 | 0.0013 | 0.0010 | 0.04 | 0.001 | 0.0019 | Cu: 0.03 | Invention steel |
| AA | 0.0026 | 3.2 | 0.30 | 0.01 | 0.0016 | 0.900 | 0.0024 | 0.0012 | 0.0013 | 0.0010 | 0.04 | 0.001 | 0.0019 | Cu: 0.10 | Invention steel |
| AB | 0.0026 | 3.2 | 0.30 | 0.01 | 0.0016 | 0.900 | 0.0024 | 0.0012 | 0.0013 | 0.0010 | 0.04 | 0.001 | 0.0019 | Cu: 0.15 | Invention steel |
| AC | 0.0025 | 3.2 | 0.20 | 0.01 | 0.0015 | 0.800 | 0.0022 | 0.0011 | 0.0011 | 0.0009 | 0.04 | 0.001 | 0.0027 | Cr: 0.5, Cu: 0.05 | Invention steel |

TABLE 2

| Steel sheet No. | Steel symbol | Sheet thickness (mm) | Finish annealing temp. (° C.) | Stress-relief annealing Temp. (° C.) | Time (hr) | Heating rate (° C./min) | Yield stress after finish annealing (MPa) | Magnetic flux density $B_{50H}$ (T) after finish annealing | $B_{50S}$ (T) after stress-relief annealing | $B_{50S}/B_{50H}$ | Iron loss after stress-relief annealing $W_{10/400}$ (W/kg) | 10 + 25 t | Motor property Motor efficiency (%) | Remarks |
|---|---|---|---|---|---|---|---|---|---|---|---|---|---|---|
| 1 | A | 0.25 | 820 | 800 | 1 | 3 | 525 | 1.65 | 1.60 | 0.970 | 10.8 | 16.25 | 87.0 | Comparative Example |
| 2 | A | 0.25 | 820 | 800 | 1 | 15 | 525 | 1.65 | 1.64 | 0.994 | 10.8 | 16.25 | 91.5 | Invention Example |
| 3 | A | 0.15 | 800 | 825 | 2 | 30 | 540 | 1.64 | 1.63 | 0.996 | 8.8 | 13.75 | 92.1 | Invention Example |
| 4 | A | 0.30 | 800 | 825 | 2 | 50 | 540 | 1.66 | 1.66 | 0.997 | 11.8 | 17.50 | 91.6 | Invention Example |
| 5 | B | 0.20 | 750 | 850 | 1 | 25 | 550 | 1.67 | 1.66 | 0.998 | 9.5 | 15.00 | 91.8 | Invention Example |
| 6 | B | 0.25 | 770 | 850 | 1 | 25 | 550 | 1.66 | 1.66 | 0.998 | 10.4 | 16.25 | 91.7 | Invention Example |
| 7 | C | 0.25 | 880 | 775 | 1 | 20 | 350 | 1.72 | 1.70 | 0.988 | 14.2 | 16.25 | 84.2 | Comparative Example |
| 8 | D | 0.20 | 830 | 825 | 2 | 30 | 570 | 1.63 | 1.62 | 0.994 | 9.5 | 15.00 | 91.6 | Invention Example |
| 9 | E | Cannot be obtained due to breakage in cold rolling | | | | | | | | | | | | Comparative Example |
| 10 | F | 0.25 | 780 | 850 | 2 | 20 | 550 | 1.64 | 1.63 | 0.995 | 9.8 | 16.25 | 91.6 | Invention Example |
| 11 | G | Cannot be obtained due to breakage in cold rolling | | | | | | | | | | | | Comparative Example |
| 12 | H | 0.23 | 770 | 830 | 1 | 15 | 420 | 1.72 | 1.72 | 1.000 | 13.8 | 15.75 | 92.0 | Invention Example |
| 13 | I | 0.23 | 770 | 830 | 1 | 15 | 420 | 1.73 | 1.73 | 1.000 | 13.2 | 15.75 | 92.1 | Invention Example |
| 14 | J | 0.23 | 770 | 830 | 1 | 15 | 420 | 1.73 | 1.73 | 1.000 | 13.2 | 15.75 | 92.1 | Invention Example |
| 15 | K | 0.23 | 770 | 830 | 1 | 15 | 440 | 1.73 | 1.73 | 1.000 | 13.2 | 15.75 | 92.1 | Invention Example |
| 16 | L | Cannot be obtained due to breakage in cold rolling | | | | | | | | | | | | Comparative Example |
| 17 | M | 0.23 | 770 | 830 | 1 | 15 | 420 | 1.73 | 1.73 | 1.000 | 12.9 | 15.75 | 92.3 | Invention Example |
| 18 | N | 0.23 | 770 | 780 | 2 | 15 | 420 | 1.72 | 1.72 | 1.000 | 13.4 | 15.75 | 91.8 | Invention Example |

TABLE 2-continued

| Steel sheet No. | Steel symbol | Sheet thickness (mm) | Finish annealing temp. (° C.) | Stress-relief annealing Temp. (° C.) | Stress-relief annealing Time (hr) | Stress-relief annealing Heating rate (° C./min) | Yield stress after finish annealing (MPa) | Magnetic flux density $B_{50H}$ (T) after finish annealing | Magnetic flux density $B_{50S}$ (T) after stress-relief annealing | $B_{50S}/B_{50H}$ | Iron loss after stress-relief annealing $W_{10/400}$ (W/kg) | Iron loss after stress-relief annealing 10 + 25 t | Motor property Motor efficiency (%) | Remarks |
|---|---|---|---|---|---|---|---|---|---|---|---|---|---|---|
| 19 | O | 0.25 | 820 | 830 | 1 | 20 | 490 | 1.65 | 1.64 | 0.994 | 10.5 | 16.25 | 91.6 | Invention Example |
| 20 | P | 0.25 | 800 | 850 | 1 | 20 | 490 | 1.65 | 1.64 | 0.994 | 10.5 | 16.25 | 91.6 | Invention Example |
| 21 | Q | Cannot be obtained due to breakage in cold rolling | | | | | | | | | | | | Comparative Example |
| 22 | R | 0.30 | 790 | 850 | 2 | 10 | 500 | 1.68 | 1.63 | 0.970 | 19.2 | 17.50 | 81.0 | Comparative Example |
| 23 | S | 0.30 | 790 | 850 | 2 | 10 | 500 | 1.68 | 1.63 | 0.970 | 19.4 | 17.50 | 80.9 | Comparative Example |
| 24 | T | 0.30 | 790 | 850 | 2 | 10 | 500 | 1.68 | 1.63 | 0.967 | 18.2 | 17.50 | 81.4 | Comparative Example |
| 25 | U | 0.30 | 790 | 850 | 2 | 10 | 500 | 1.68 | 1.63 | 0.971 | 18.6 | 17.50 | 81.3 | Comparative Example |
| 26 | V | 0.30 | 790 | 850 | 2 | 10 | 500 | 1.68 | 1.62 | 0.967 | 18.9 | 17.50 | 81.1 | Comparative Example |
| 27 | W | 0.25 | 800 | 835 | 1 | 30 | 510 | 1.69 | 1.68 | 0.993 | 11.7 | 16.25 | 90.6 | Invention Example |
| 28 | X | 0.25 | 800 | 835 | 1 | 30 | 495 | 1.69 | 1.68 | 0.993 | 11.7 | 16.25 | 90.6 | Invention Example |
| 29 | Y | 0.25 | 800 | 835 | 1 | 30 | 485 | 1.69 | 1.68 | 0.992 | 11.7 | 16.25 | 90.6 | Invention Example |
| 30 | Z | 0.25 | 800 | 835 | 1 | 30 | 510 | 1.70 | 1.68 | 0.994 | 11.9 | 16.25 | 90.5 | Invention Example |
| 31 | AA | 0.25 | 800 | 835 | 1 | 30 | 510 | 1.70 | 1.69 | 0.993 | 11.9 | 16.25 | 90.6 | Invention Example |
| 32 | AB | 0.25 | 800 | 835 | 1 | 30 | 510 | 1.71 | 1.69 | 0.994 | 11.9 | 16.25 | 90.6 | Invention Example |
| 33 | AC | 0.25 | 800 | 835 | 1 | 30 | 505 | 1.71 | 1.70 | 0.994 | 11.7 | 16.25 | 90.8 | Invention Example |

EXAMPLE 2

A set of a rotor core and stator core is produced from each of the non-oriented electrical steel sheets after the finish annealing, and further the stator core is subjected to a stress-relief annealing in a $N_2$ atmosphere by heating from 600° C. to 850° C. at 10° C./min and holding at 850° C. for 1 hour and then assembled into one IPM motor to measure an efficiency of the motor. Moreover, the IPM motor used in the above measurement has an outer diameter of stator of 150 mm, a lamination thickness of 25 mm and a motor output of 300 W. Also, the measurement is performed at 1500 rpm under a driving force of 2 Nm, whereby the efficiency of the motor is measured at the same output.

The above measured results are also shown in Table 2. As seen from these results, the motors produced from the steel sheets according to embodiments of the present invention are stably high in efficiency of the motor.

The invention claimed is:

1. A method for producing a non-oriented electrical steel sheet by hot rolling and cold rolling a steel slab having a chemical composition comprising C: not more than 0.0050 mass %, Si: 2-7 mass %, Mn: 0.05-2.0 mass %, P: not more than 0.01 mass %, S: not more than 0005 mass %, Al: not more than 3 mass %, N: not more than 0.005 mass %, Ti: not more than 0.003 mass %, Nb: not more than 0.005 mass %, V: not more than 0.005 mass % and the remainder being Fe and inevitable impurities and then subjecting the resultant sheet to a finish annealing and a stress-relief annealing, characterized in that conditions of the finish annealing and stress-relief annealing are adjusted so that a yield stress of the steel sheet after the finish annealing is not less than 400 MPa and a ratio ($B_{50S}/B_{50H}$) of a magnetic flux density $B_{50S}$ of the steel sheet subjected to the stress-relief annealing after the finish annealing to a magnetic flux density $B_{50H}$ of the steel sheet after the finish annealing is not less than 0.99, wherein a soaking temperature is 750-950° C. and a soaking time is 0.1-10 hour and a heating rate from 600° C. to the soaking temperature is not less than 8° C./min as the condition of the stress-relief annealing.

2. The method for producing a non-oriented electrical steel sheet according to claim 1, wherein the steel slab contains at least one of the following groups A-C:

Group A: one or two selected from Sn: 0.005-0.20 mass % and Sb: 0.005-0.20 mass %;

Group B: one or more selected from Ca: 0.001-0.010 mass %, Mg: 0.001-0.010 mass % and REM: 0.001-0.010 mass %;

Group C: one or two selected from Cr: 0.01-0.5 mass % and Cu: 0.01-0.2 mass %;

in addition to the above chemical composition.

3. The method for producing a non-oriented electrical steel sheet according to claim 2, wherein the condition of the stress-relief annealing is adjusted so as to satisfy the following equation (1):

$$W_{10/400} \leq 10+25t \quad (1),$$

wherein $W_{10/400}$ (W/kg) is an iron loss after the stress-relief annealing and t (mm) is a sheet thickness.

4. The method for producing a non-oriented electrical steel sheet according to claim 1, wherein the condition of the stress-relief annealing is adjusted so as to satisfy the following equation (1):

$$W_{10/400} \leq 10+25t \quad (1),$$

wherein $W_{10/400}$ (W/kg) is an iron loss after the stress-relief annealing and t (mm) is a sheet thickness.

* * * * *